United States Patent [19]

Sakane et al.

[11] Patent Number: 4,840,541

[45] Date of Patent: Jun. 20, 1989

[54] FAN APPARATUS

[75] Inventors: Takaaki Sakane, Nagoya; Kazuhiro Takeuchi, Chita, both of Japan

[73] Assignee: Nippondenso Co., Ltd., Kariya, Japan

[21] Appl. No.: 167,309

[22] Filed: Mar. 11, 1988

[30] Foreign Application Priority Data

Mar. 13, 1987 [JP] Japan ..... 62-59194
Feb. 24, 1988 [JP] Japan ..... 63-41435

[51] Int. Cl.[4] ..... F04D 29/38

[52] U.S. Cl. ..... 416/223 R; 415/119; 416/DIG. 2

[58] Field of Search ..... 416/223 R, 169 A, DIG. 2; 415/119

[56] References Cited

U.S. PATENT DOCUMENTS

| | | | |
|---|---|---|---|
| 958,599 | 5/1910 | Cooksey | 416/238 |
| 2,013,473 | 9/1935 | Meyer | 416/235 |
| 2,116,054 | 5/1938 | Weichwald | 174/86 |
| 3,194,068 | 10/1975 | Nonnenmann | 73/861.16 |
| 4,120,609 | 10/1978 | Chou et al. | 416/223 R |
| 4,180,024 | 12/1979 | Hernandez | 123/41.46 |
| 4,284,388 | 8/1981 | Szewalski | 416/223 A |
| 4,568,242 | 2/1986 | Susa et al. | 416/169 A |
| 4,632,636 | 12/1986 | Smith | 416/DIG. 2 |
| 4,684,324 | 8/1987 | Perosino | 415/119 |

FOREIGN PATENT DOCUMENTS

| | | | |
|---|---|---|---|
| 2144600 | 3/1973 | Fed. Rep. of Germany . | |
| 735817 | 11/1932 | France . | |
| 1050838 | 1/1954 | France . | |
| 535425 | 11/1955 | Italy . | |
| 6167 | of 1911 | United Kingdom | 416/DIG. 2 |
| 541681 | 12/1941 | United Kingdom . | |

*Primary Examiner*—Robert E. Garrett
*Assistant Examiner*—John T. Kwon
*Attorney, Agent, or Firm*—Cushman, Darby & Cushman

[57] ABSTRACT

A fan apparatus for preventing the occurrence of a burble on a surface of a blade while the resistance to air flow into the fan is increased and the generated noise is kept small. Each fan of the blade has a first area which extends from the bottom portion of the blade to the intermediate portion and a second area from the intermediate portion of the blade to the top portion of the blade. The setting angle of the blade is a first, predetermined angle at the first area of the blade but is increased at the second area of the blade. Further, the chord length of the blade gradually increases from the bottom to the top of the blade. Additionally, a first wing axis of the blade in the first area is not parallel to a second wing axis of the blade at the second area but, rather, the second wing axis is inclined towards the rotational direction of the fan apparatus. Finally, the profile of the blade of the invention is formed so that the profile at the first area is perpendicular to the first wing axis and the profile at the second area is perpendicular to the second wing axis. With such a structure, a pressure distribution along the wing chord is substantially the same at the first area and the pressure distribution along the wing chord at the second area is gradually increased so that the shape of the pressure distribution is similar to that of the first area.

5 Claims, 12 Drawing Sheets

(a)

(b)

FAN APPARATUS

FIELD OF THE INVENTION

A present invention relates to a fan apparatus which is useful as a radiator fan for cooling an automotive radiator, for example.

BACKGROUND OF THE INVENTION

An automotive radiator for cooling a coolant of an engine is provided in front of the engine 5 as shown in FIG. 3. The radiator 4 has an upper tank 4*a*, a lower tank 4*c* and a radiating core 4*b* provided between the upper tank 4*a* and the lower tank 4*c*. The radiating core 4*b* has a plurality of tubes and fins thermally connected to the tubes. A fan apparatus 12 is provided between the radiator 4 and the engine 5 for blowing the cooling air toward the radiating core. The fan apparatus has a boss 2 which is rotated by the outer driving source such as an electric motor and a plurality of blades 1 which is connected on the outer surface of the boss 2. A fan shroud 3 is provided in such a manner that the fan shroud 3 surrounds the fan apparatus 1 so that the cooling air generated by the fan apparatus 1 is introduced toward the fan apparatus.

A condenser 6 condensing a refrigerant of an automotive air conditioner is provided in front of the radiator 4. A front grille 8 is opened at the front end portion of a hood 10 so that the air through the front grille flows toward the condenser 6 and the radiator 4. The reference numeral 7 shows automotive bumper, the numeral 9 shows a skirt portion.

Since the engine 4 requires cooling efficiency, the radiator 4 is also required effective heat exchanging function. Accordingly, the radiator 4 employs the radiating core 4*b* which has a louvered fin the pitch of which is very narrow in order to increase the effective heat exchanging area, so that the resistance of the air passing through radiator has increased.

Furthermore, since the air passes through the radiator 4 should also pass through the condenser 6, the total resistance of the radiator 4 and condenser 6 should be quite high. The opening area of the front grille 8 has been decreased in order to reduce the coefficiency of the resistance of the automobile resently, so that the resistance of the air introducing into the fan apparatus 1 has been increased.

The increment of the resistance of the air also increases the noise generated by the fan. The conventional type of the fan apparatus cannot decrease the noise.

After the present inventors had examined about the relationship between the resistance of the air introduced into the fan apparatus and the noise caused by the fan apparatus, the present inventors presumed that the air flow passing through fan apparatus is varied in accordance with the resistance of the air introduced into the fan apparatus. The present inventors observed the air flow on the surface of the blade under the situation that the resistance of the air introduced into the fan apparatus was varied. According to the observation of the present inventors, the air flow passing through the fan apparatus 12 is parallel with the axis of the boss 2 as shown by the allow F in FIG. 4 and the vibration of the tuft attached on the surface of the blade is small while the resistance of the air introduced into the fan apparatus is small.

The air passing through the fan apparatus 12 under such situation flows in such a manner that the air makes concentric circles as shown in FIG. 5. The allow R shown in FIGS. 4 and 5 indicates the rotating direction of the blade 1.

The air passing through the fan apparatus 12 curves outwordly as shown in FIG. 6, and the tuft attached on the inner end of the blade vibrates strongly while the resistance of the air introduced into the fan apparatus is high. As shown from FIG. 7 which shows one blade 1 of a plurality of blades of the fan apparatus 12, the air passing through the outer surface of the blade flows outwordly.

The angle of incidence $\alpha$ is deemed to be increased when the resistance of the air introduced into the fan apparatus is high. Since the angle of incidence relates to the fan noise and the fan performance, the stall is occurred when the angle of incidence becomes too large. The angle of incidence $\alpha$ is calculated as the angle between a line T tying the leading edge 1*a* and the training edge 1*b* of the blade 1 and a line F which indicates the air flow introduced into the blade 1 as shown FIG. 2. The letter $\beta$ designates a setting angle which is calculated as the angle between a line T and a line R which shows the rotating direction of the blade. The letter L designates chord length between the leading edge 1*a* and the trailing edge 1*b*. The setting angle $\beta$ of the conventional type of fan apparatus decreases from the bottom portion to the intermediate portion of the blade 1 and decreases from the intermediate portion to the top portion, of the blade, as described by line J in FIG. 9. The velocity of the air passing through the top portion of the blade increases when the setting angle $\beta$ of the blade at the top portion increases, so that the turbulence of the air around the top portion is ceased. The setting angle $\beta$ at the bottom portion of the blade 1 is increased in order to make the amount of the air passing through the bottom portion increases. However, since the angle of the incidence $\alpha$ becomes high in accordance with the increment of the resistance of the air introduced into the fan apparatus, the occurrence of the stall on the both inner end and the outer end of the blade is predicted, and which causes the noise at those areas.

As described above, the air flow flowing on the surface of the blade 1 curves outwardly when the resistance of the air introduced into the fan apparatus is increased. The sectional shape of the blade is so designed that the fan profile as shown in FIG. 10 (*a*) is at X—X portion of the FIG. 8 which is perpendicular to the wing axis 1. The sectional shape of the blade, however, cannot maintain the fan profile and is such an irregular shape that described in FIG. 10(*b*) along with XI—XI line of FIG. 8 which is parallel with the derection of the air flow when the resistance becomes high. The XI—XI line of FIG. 8 designates the direction of air flow when the resistance is high as shown in FIG. 7. Therefore, the air flow flowing along with XI—XI line cannot flow smoothly so that the burble is occurred.

SUMMARY OF THE INVENTION

The present invention has an object to provide a fan apparatus well preventing an occurrence of a burble on a surface of a blade even though a resistance of air flow introduced into the fan apparatus is increased. Another object of the present invention is to provide an fan apparatus generating small noise.

In order to attain above objects, the present invention employs such structure that a setting angle of the blade is kept to be a predetermined angle at a first area from a bottom portion of the blade to an intermediate portion of the blade and the setting angle is increased at a second area from the intermediate portion of the blade to a top portion of the blade. A chord length of the blade of the present invention gradually increases from the bottom portion to the top portion. A first wing axis of the blade at the first area from the bottom portion to the intermediate portion and a second wing axis of the blade at the second area from the intermediate portion to the top portion are not parallel from each other but the second wing axis is inclined toward the rotational direction of the fan apparatus. Furthermore, the profile of the blade of the present invention is formed in such a manner that the profile at the first area is perpendicular to the first wing axis and the profile at the second area is perpendicular to the second wing axis. The fan apparatus of the present invention employs such structures that a pressure distribution along with the wing chord is substantially the same at the first area from the bottom portion to the intermediate portion and a pressure distribution along with the wing chord at the second area is gradually increased in such a manner that the shape of the pressure distribution is the similar figures to that of the first area. The chord length of the blade is gradually increased from the bottom portion to the top portion.

Since the fan apparatus of the present invention employs the structures described above, the fan apparatus well prevent the occurrence of the burbling at the outer surface of the blade even the resistance of the air flow introduced into the fan apparatus is high and the air flow passing the blade is incline to the wing chord.

BRIEF DESCRIPTION OF THE DRAWINGS

FIG. 10(*b*) is a sectional view of the blade taken along with XI—XI line of FIG. 8.

DETAIL DESCRIPTION OF THE PREFERRED EMBODIMENT

Figure 1:
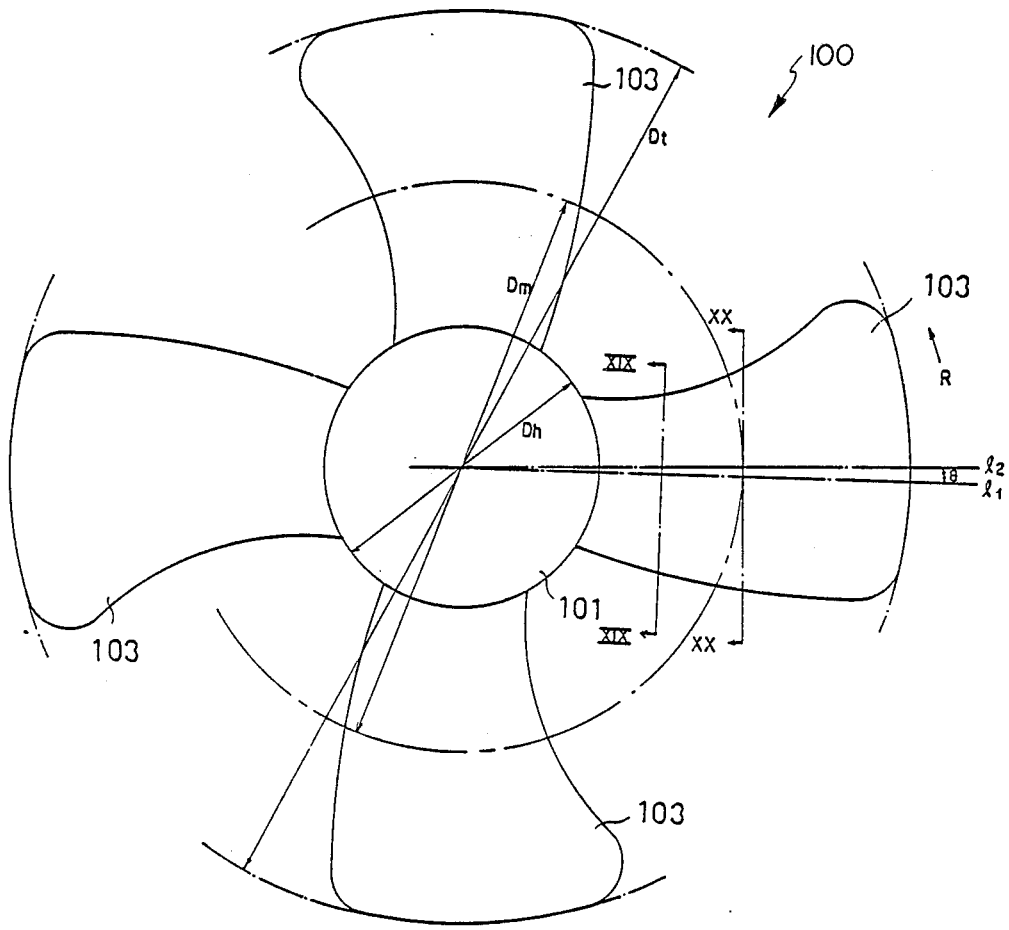
FIG. 1 is a front view of the fan apparatus of the present invention.
Figure 2:
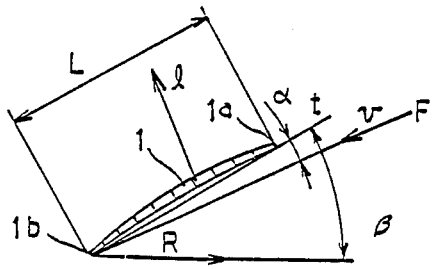
FIG. 2 is a sectional view of the blade of the fan apparatus.
Figure 3:
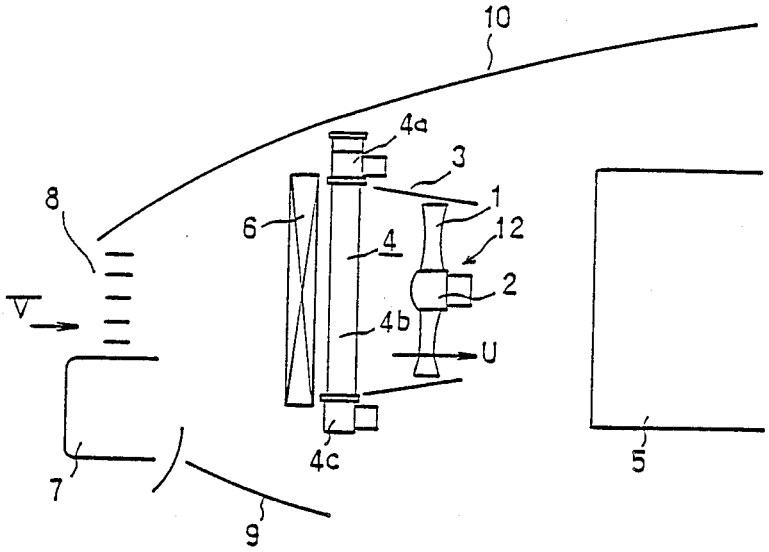
FIG. 3 shows the layout of the front portion of the automobile.
Figure 4:
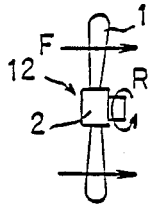
FIG. 4 is a side view of the fan apparatus.
Figure 5:
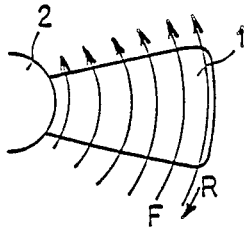
FIG. 5 is a front view of the blade of the fan apparatus.
Figure 6:
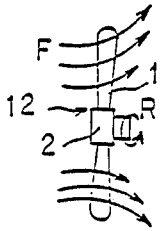
FIG. 6 is a side view of the fan apparatus.

FIG. 1 shows an fan apparatus for cooling an automotive engine radiator. The fan apparatus 100 is provided between the engine and the radiator. Four blades 103 are provided at the side surface of an cylindrical boss 101 which is driven by an electric motor. The boss portion 101 and four blades 103 are formed integrally from resin material. The intermediate portion of the blade is calculated by the formula of $$\frac{Dh + (Dt - Dh)}{2} = Dm$$

wherein Dh represents the diameter of boss portion 101, Dt represents the diameter of the circle drawn by the top portion of the blade, and Dm represents the diameter of the circle drawn by the intermediate portion.

Figure 9:
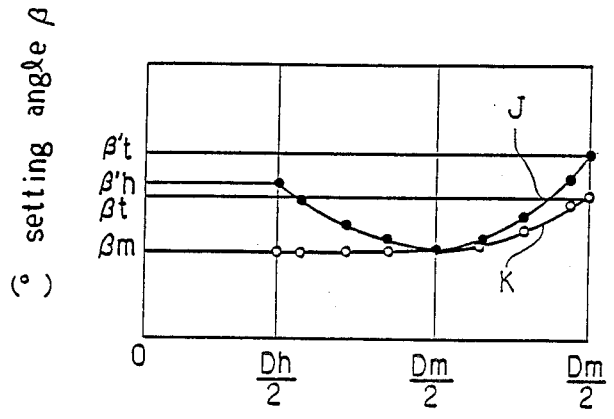
FIG. 9 shows the setting angle of the blade.
Figure 12:
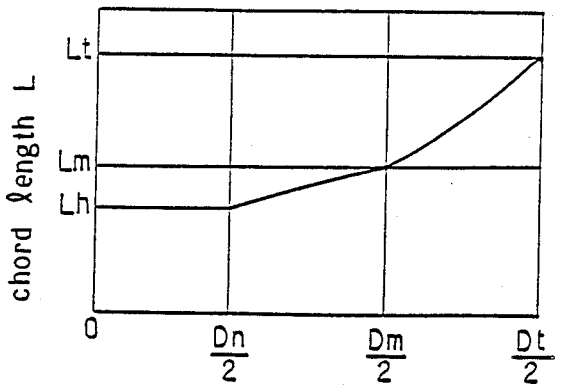
FIG. 12 shows the chord length of the blade.

The setting angle of the blade 103 is maintained to be a predetermined setting angle $\beta m$ at a first area from the bottom portion(Dh/2) to the intermediate(Dm/2). The setting angle $\beta$ then gradually increases at a second area from the intermediate portion(Dm/2) to the top portion(Dt/2), as shown by line K in FIG. 9 the letter $\beta m$ represents the setting angle at the intermediate portion, the letter $\beta t$ represents the setting angle at the top portion. The angle of incidence $\alpha$ becomes small in accordance with the setting angle $\beta$ at the second area, so that the stall is well prevented even though the resistance of the air flow introduced into the fan apparatus becomes high. It should be noted that the lift of the blade becomes also small when the angle of incidence $\alpha$ is small, so that the volume of the air flow passing through the fan apparatus should be small. The fan apparatus is required to have the lift at least as much as that of the conventional fan apparatus. Since the lift 1 is incorporate with formula of $$l\alpha R\rho V^2 S$$

wherein $\rho$ represents the density of the air, V represents the velocity of the air flow, s represents the ares of the blade and R represents the lift coefficient, and since the lift coefficient R is incorporated with the angle of incidence, the area of the blade s should be increased for compensating the reduction of the angle of incidence $\alpha$. Accordingly, the chord length L should be large in order to reduce the angle of the incidence $\alpha$. The velocity Ca of the air flow caused by the fan apparatus 100 is designed in such a manner that the velocity Ca is small at the first area from the bottom portion to the intermediate portion and the velocity Ca is gradually increased at the second area from the intermediate portion to the top portion, so that the volume of the air flow passing through the first area is small. The volume of the air flow cannot increase very much even though the increment of the chord length L under the condition that the resistance of the air flow is high. Moreover, the increment of the chord length I, causes the burbling on the outer surface of the blade which makes the noise. In order to prevent such disadvantage, the blade of the present embodiment has the small length of the chord length L which is gradually increases at a first area, as shown in FIG. 12.

The chord length L of the blade of the present embodiment increases quickly at the second area from the intermediate portion to the top portion in order to generate much volume of the air flow. So that the blade of the present embodiment convexes toward the rotational direction R as shown in FIG. 1. The relationship between the chord length Lt at a top portion and a chord length Lm at a intermediate portion is set by the next formula $$1.2Lm \leqq Lt \leqq 2.2Lm$$

A first wing axis $l_1$ which represents a center point of the chord length of the first area and a second wing axis $l_2$ which represents the center point of the chord length at a second area are described in FIG. 1. Since the blade convexes toward rotational direction at the second area, the second wing axis $l_2$ inclines toward the rotating direction by the predetermined angle $\theta$ from the first wing axis $l_1$. The predetermined angle $\theta$ is so declined that the angle $\theta$ relates to the chord length, and the chord length is designed by the required output of the fan apparatus and the outer diameter of the blade. The predetermined angel $\theta$ of the present embodiment is 3°-17°.

Figure 10:
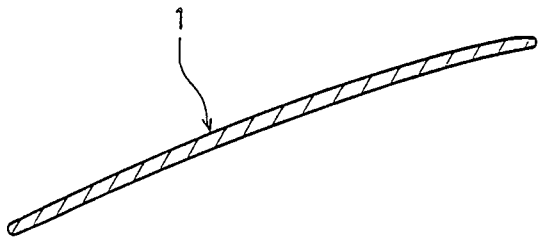
FIG. 10(*a*) is a sectional view taken along is X—X line of FIG. 8.
Figure 10:
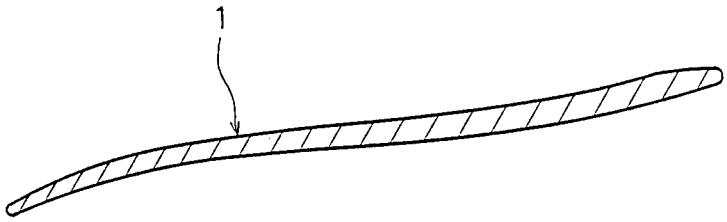
Figure 11:
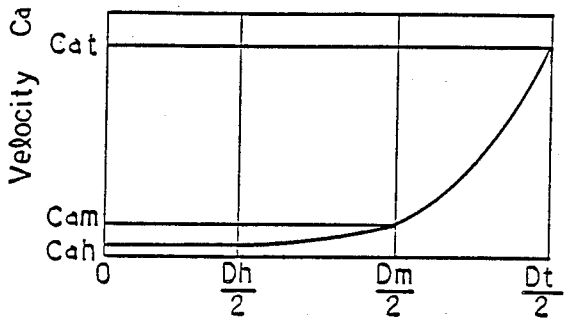
FIG. 11 shows the velocity of the air flow passing through the blade.

The profile of the blade which is perpendicular to the first wing axis $l_1$ is designed to be the shape shown in FIG. 10(*a*) at the first area from the bottom portion to the intermediate portion. The profile of the blade which is perpendicular to the second wing axis $l_2$ is designed to be the similar shape as that described in FIG. 10(*a*).

Figure 7:
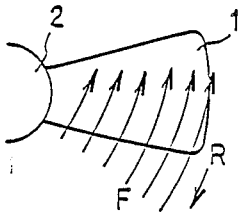
FIG. 7 is a front view of the blade of the fan apparatus.
Figure 8:
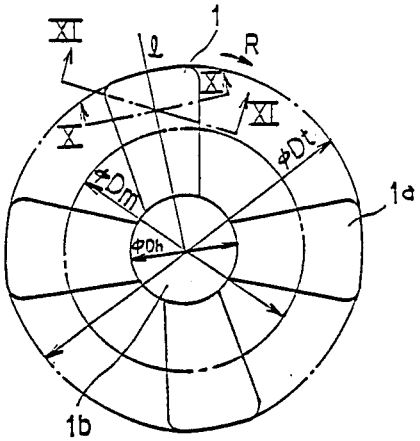
FIG. 8 is a front view of the confentional type of the fan apparatus.
Figure 19:
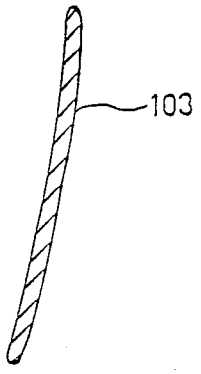
FIG. 19 is a sectional view of the blade taken along with XIX—XIX line of FIG. 1.
Figure 20:
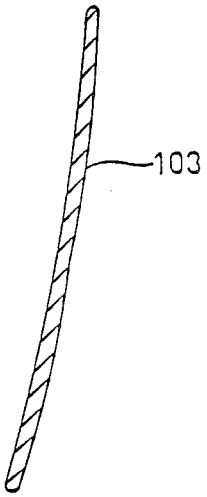
FIG. 20 is a sectional view of the blade taken along with XX—XX line of FIG. 1, FIGS. 21 and 22 show the noise of the fan apparatus.

As shown in FIG. 19 which shows the sectional shape of the blade taken along with XIX—XIX line of FIG. 1 and FIG. 20 which shows the sectional shape of the blade taken along with XX—XX line in FIG. 1, the sectional shape of the blade is so designed that the profile of the blade is fit to the air flow passing through the blade even though the air flow curves as shown in FIG. 7. So that the blade of the present embodiment can well prevent the occurrence of the burbling on the outer surface of the blade and can prevent the noise.

Figure 13:
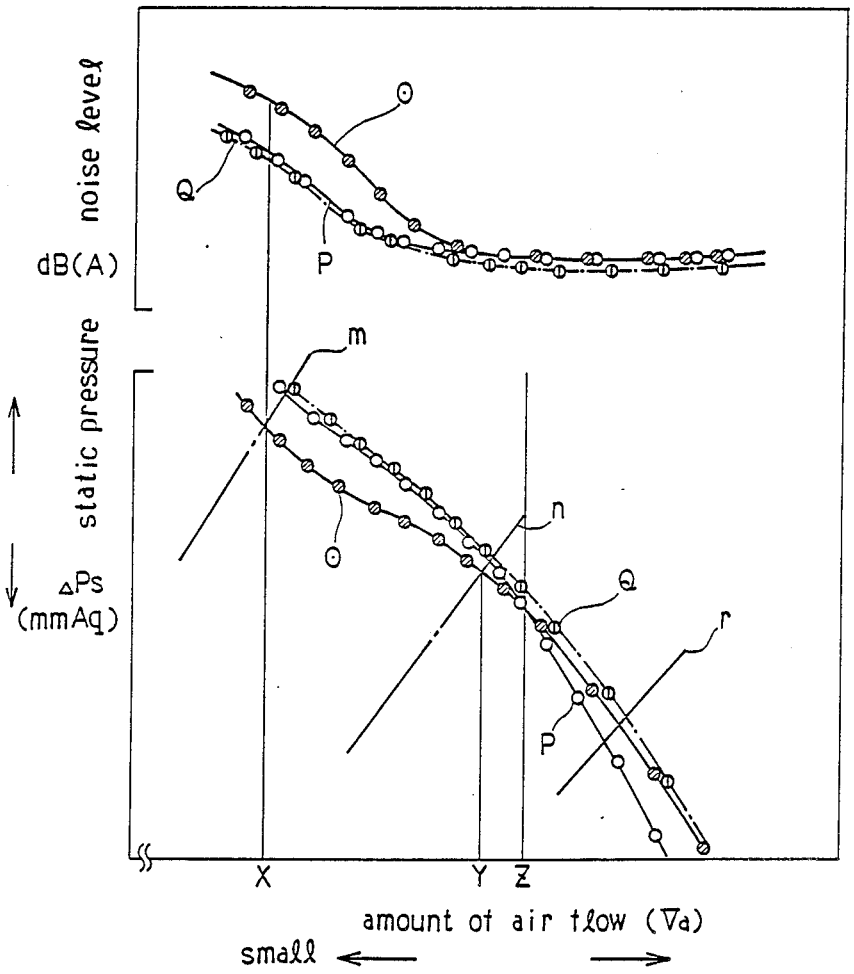
FIG. 13 shows the relationship between the amount of the air and the noise.

The effect of the present embodiment for reducing the noise is shown in FIG. 13. The line 0 in FIG. 13 represents the conventional type of the fan, and the line P in FIG. 13 represents the present embodiment. The ordinate of FIG. 13 indicates the static pressure which is the pressure difference between the upper surface of the blade and the lower surface of the blade. The line M represents the resistance of the air introduced into the fan apparatus when the automobile does not move, the line N represents the resistance when the automobile moves slowly and the line represents the resistance when the automobile moves fast. As shown in FIG. 13, the fan apparatus of the present embodiment can reduce the noise at the point X when the automobile does not move. It should be noted that the fan noise makes the passengers in the vehicle inconvenience when the automobile does not move. Furthermore, the fan apparatus of the present embodiment can improve the static pressure which means that the fan apparatus of the present embodiment can increase the amount of the air flow. The fan apparatus having four blades and the outer diameter Dt of which is 300 mm, the boss portion the diameter of which is 90 mm and the electric motor the output of which is 80 W (2180 rpm) is used for the examination of FIG. 13.

Figure 14:
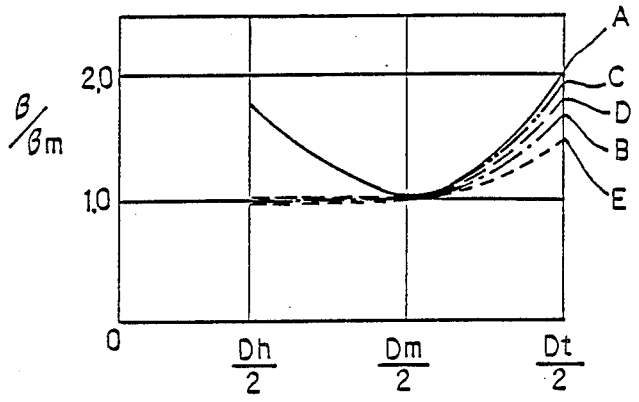
FIG. 14 shows the setting angle of the blades.
Figure 15:
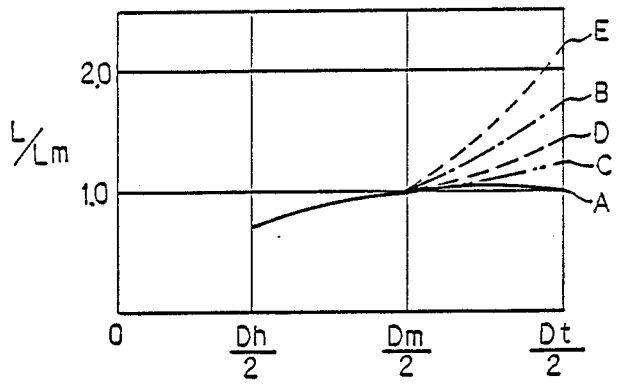
FIG. 15 shows the chord length of the blade.

FIG. 14 shows the variation of the fan apparatus of the present invention which has the substantially same angle of setting angle at the first area from the bottom portion to the intermediate portion to the setting angle at a second area between the intermediate portion and the top portion. The dot line B, C, D and E represents the fan apparatus having the relation between the setting angle $\beta T/\beta m$ is 1.7, 1.9, 1.8 and 1.5 respectively, the solid line A represents a conventional type of fan apparatus. The chord length of the fan apparatuses which are respect to the fan apparatuses A, B, C, D and E in FIG. 14 are described in FIG. 15. As described in FIG. 15, the relationship between the chord length at the intermediate portion and the chord length each of other position of the blade of the conventional type of the fan apparatus is maintained substantially the same value(solid line A). The relationship of that of the present embodiments are gradually increased toward the top portion. The relationship of Lt/Lm of the fan apparatus designated by the dot line B, C, D and E are 1.7, 1.2, 1.4 and 2.2 respectly.

Figure 16:
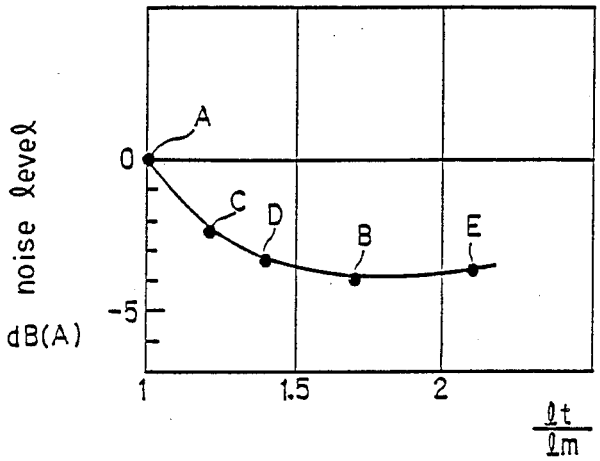
FIG. 16 shows the noise of the fan apparatus.

The noise generated by the fan apparatus of A, B, C, D and E is plotted in FIG. 16. The fan apparatus B, C, D and E of the present embodiment can reduce the noise by 2.5–4 decibel from the conventional type of the fan apparatus A. Even though the fan apparatus having the relationship of the chord length of Lt/Lm is more than 2.2 is deemed to gain the reduction of the noise, the relation of the chord length Lt/Lm is also deemed to bring another disadvantage that the fan apparatus cannot maintain the enough strength under the special condition that the boss rotates by high speed, so that the relation of the chord length Lt/Lm is predicted that the Number between 2.0–2.5 is most practically.

The setting angle $\beta$ at the first area is so maintained that, the pressure distribution along with the chord length of the blade 103 is substantially similar. The setting angle $\beta$ at the second area is gradually increases so that, the pressure distribution on the chord length at the second area is gradually increased toward the top portion by keeping the shape of the pressure distribution similar.

The fan apparatus of the present invention can modified within the scope of the invention. Namely, the first area of the blade is formed from the bottom portion to the intermediate portion which is outer side of the mean portion of the blade.

Figure 23:
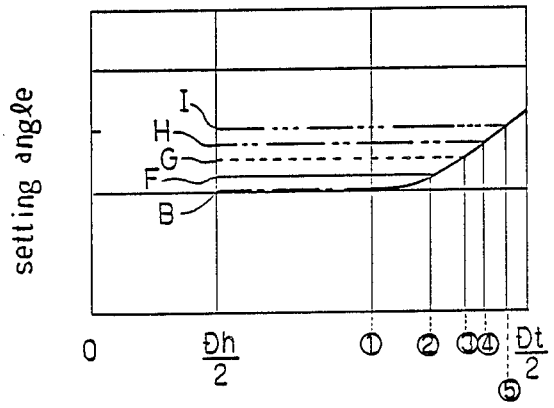
FIG. 23 shows the setting angle of the blades.

The distribution of the setting angle $\beta$ of the present invention can also be valid. In FIG. 23 which shows the modified setting angle $\beta$, the dot line B represents the same blades described by dot line B in FIG. 14, the dot lines F, G, H and I shows the modified fan blades having a same outer diameter Dt as that of the fan B and the same output as that of the fan B. The setting angle at the first area of the fans F, G, H and I is greater than that of the fan B, the setting angle $\beta f$ of the fan F is 1.1 times by that of the fan B $\beta b$, the setting angle $\beta g$ of the Fan G is 1.3 times by $\beta b$, the setting angle $\beta h$ of the fan H is 1.4 times by $\beta b$ and the setting angle $\beta i$ of the fan I is 1.5 times by $\beta b$. The first area of the blade F is between the bottom portion and the intermediate portion calculated by the formula of $$\tfrac{1}{2}\{Dh+0.71(Dt-Dh)\},$$

the first area of the blade G is between the bottom portion and the intermediate portion calculated by the formula of $$\tfrac{1}{2}\{Dh+0.79(Dt-Dh)\},$$

the first area of blade edge is between the bottom portion and the intermediate portion calculated by the formula of $$\frac{1}{2}\{Dh+0.88(Dt-Dh)\},$$

and the first area of the blade H is between the bottom portion and the intermediate portion calculated by the formula of $$\frac{1}{2}\{Dh+0.95(Dt-Dh)\}.$$

Figure 21:
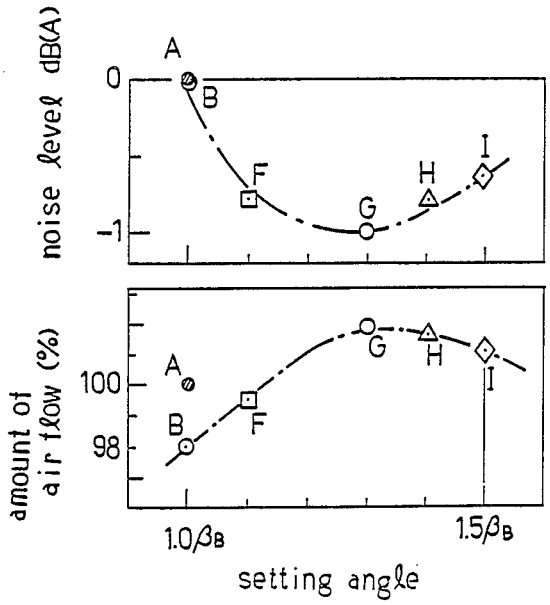
Figure 22:
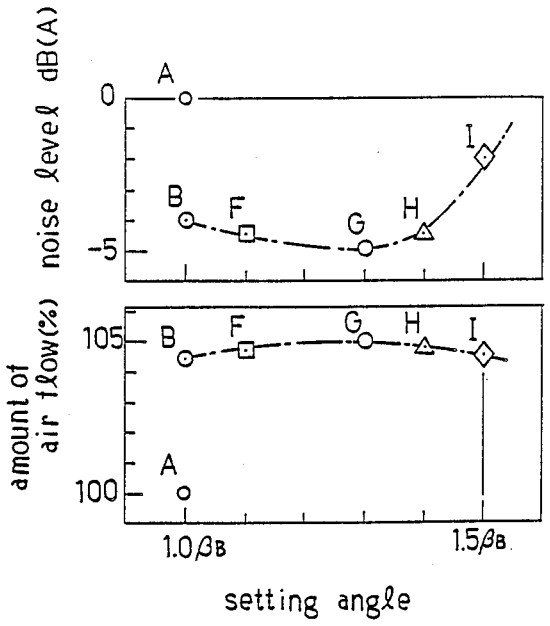

The propotion between the chord length at the top portion and that of the intermediate portion $\beta m/\beta t$ of the blades F, G, H and I are 0.64, 0.76, 0.82 and 0,88 respectively. The noise caused by the blades F, G, H and I and the amount of the air flow passing through the blades F, G, H and I under the condition that the automobile moves fast(the condition represented r in FIG. 13) are described in FIG. 21. The noise caused by the fan F, G, H and I and the amount of the air flow through the blades F, G, H and I under the condition that the automobile does not move (the condition represented by m in FIG. 13) are described in FIG. 22. As shown from FIGS. 21 and 22, the blade G works most effectively. The dot line Q in FIG. 13 represents the test data of the blade G.

Figure 17:
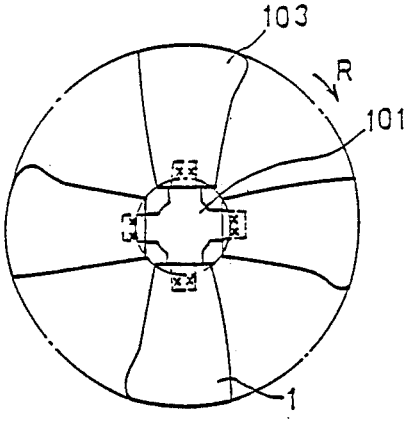
FIGS. 17 and 18 are front views of fan apparatus
Figure 18:
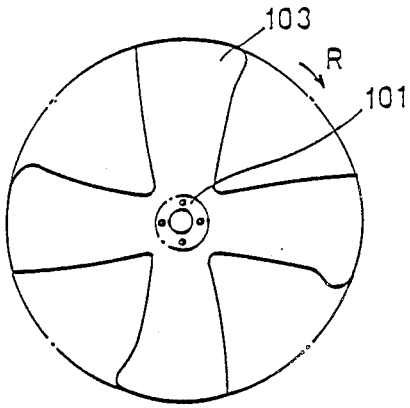

Even though the fan apparatus shown in FIG. 1 has four blades, the fan apparatus of the present invention can employs more than five blades. The blades 103 and the boss portion 101 of the fan apparatus does not have to be formed integrally, the blade 103 can be made of metal plate such as aluminum and steel and welded to the boss portion as shown in FIG. 17. Furthermore, the blade 103 can be connected to the boss portion 102 by the connecting means such as ribet. The fan apparatus of the present invention can be positioned in front of the radiator for sending the cooling air toward the radiator 4. The fan apparatus of the present invention can be used other than the cooling fan for cooling the automotive radiator such as the ventalator.

What is claimed:

1. A fan apparatus having a boss portion which is driven to be rotated and a plurality of blades connected to said boss portion in such a manner that said boss portion positions at a center position of said a plurality of blades, wherein;

a setting angle of said blade at a first area from a bottom portion of said blade to an inter mediate portion is maintained substantially the same, the setting angle of the said blade at a second area from said intermediate portion to a top portion of said blade is gradually increased, a chord length of said blades is gradually increased from the bottom portion to the top portion of said blade, a first wing axis which represents a center portion of the chord length at the first area from the bottom portion to the intermediate portion of the blade is inclined to a second wing axis which represents the center portion of the chord length at the second area from the intermediate portion to the top portion in such a manner that the second wing axis inclined toward a rotating direction of said boss from the first wing axis; and a profile of said blade is so formed that the profile at the first area is perpendicular to the first wing axis and the profile at the second area is perpendicular to the second wing axis.

2. A fan apparatus claimed in claim 1, wherein the setting angle of said blade at the first area is 0.5–0.9 times by the setting angle of said blade at the top portion.

3. A fan apparatus claimed in claim 1, wherein the intermediate portion of said blade is a portion about 0.5–0.95 times by a length of said blades.

4. A fan apparatus claimed in claim 1, wherein the chord length at the top portion of said blade is about 1.2–2.2 times by the chord length at the intermediate portion of said blade.

5. A fan apparatus claimed in claim 1, wherein an inclined angle between the first wing axis and the second wing axis is about 3°–17°.

* * * * *